US009321547B2

(12) United States Patent
Miyamoto et al.

(10) Patent No.: US 9,321,547 B2
(45) Date of Patent: Apr. 26, 2016

(54) PACKAGING MACHINE

(75) Inventors: Hideshi Miyamoto, Shiga (JP); Masashi Kondo, Shiga (JP); Makoto Ichikawa, Shiga (JP)

(73) Assignee: ISHIDA CO., LTD., Kyoto (JP)

( * ) Notice: Subject to any disclaimer, the term of this patent is extended or adjusted under 35 U.S.C. 154(b) by 654 days.

(21) Appl. No.: 13/398,435

(22) Filed: Feb. 16, 2012

(65) Prior Publication Data

US 2012/0204514 A1 Aug. 16, 2012

(30) Foreign Application Priority Data

Feb. 16, 2011 (JP) ..... 2011-030641

(51) Int. Cl.

| | |
|---|---|
| ***B65B 1/04*** | (2006.01) |
| ***B65B 9/213*** | (2012.01) |
| ***B65B 1/22*** | (2006.01) |
| ***B65B 1/32*** | (2006.01) |
| ***B65B 9/20*** | (2012.01) |
| *B65B 51/30* | (2006.01) |

(52) U.S. Cl.

CPC . *B65B 9/213* (2013.01); *B65B 1/22* (2013.01); *B65B 1/32* (2013.01); *B65B 9/2007* (2013.01); *B65B 9/2028* (2013.01); *B65B 51/303* (2013.01)

(58) Field of Classification Search

CPC ..... B65B 9/213; B65B 1/22; B65B 9/08; B65B 31/04; B65B 19/00; B65B 9/2028; B65B 9/2007; B65B 51/3067; B65B 1/32; B65B 51/303

USPC ..... 53/235, 551, 540, 511, 151, 248, 437, 53/374.4, 247, 552, 374.3; 15/246.2

See application file for complete search history.

(56) References Cited

U.S. PATENT DOCUMENTS

| | | | | |
|---|---|---|---|---|
| 2,828,590 A * | 4/1958 | Swartz et al. | ..... | 53/431 |
| 3,525,193 A | 8/1970 | Cutler et al. | | |
| 4,262,473 A * | 4/1981 | Brooke | ..... | 53/450 |
| 4,656,818 A * | 4/1987 | Shimoyama | ..... | B29C 66/0342 53/374.4 |

(Continued)

FOREIGN PATENT DOCUMENTS

| | | |
|---|---|---|
| EP | 2004039 B | 8/1971 |
| EP | 0023128 A1 | 1/1981 |

(Continued)

OTHER PUBLICATIONS

Extended European Search Report of the corresponding European Application No. 12155802.7, dated Dec. 20, 2012.

*Primary Examiner* — Gloria R Weeks
*Assistant Examiner* — Justin Citrin
(74) *Attorney, Agent, or Firm* — Global IP Counselors, LLP

(57) ABSTRACT

A packaging machine includes a pair of brushes that hold a tubular film (Fm) therebetween while rotating and impeding the advancement of packaged articles. Consequently, an elongated stream of packaged articles aggregate at the leading end of the pair of brushes. When the pair of brushes release the tubular film, the packaged articles are again conveyed in a more closely aggregated state than the aggregated state thereof when the advancement of the packaged articles was temporarily impeded. The rotational axis of each brush is also biased a predetermined distance from the central axis of a core thereof. Since the brushes swing in conjunction with the rotation thereof, small vibrations and large swings cause the gaps between packaged articles to be readily filled and reduce the space occupied by the packaged articles. As a result, the bag size can be reduced.

8 Claims, 14 Drawing Sheets

(56) References Cited

U.S. PATENT DOCUMENTS

| | | | | |
|---|---|---|---|---|
| 5,241,804 | A * | 9/1993 | Tsuruta | B65B 9/12 53/504 |
| 5,452,490 | A * | 9/1995 | Brundula | A47L 9/0477 15/179 |
| 5,473,866 | A * | 12/1995 | Maglecic et al. | 53/511 |
| 6,427,422 | B2 * | 8/2002 | Nakagawa et al. | 53/437 |
| 7,546,722 | B2 * | 6/2009 | Tsuruta | B29C 65/18 53/375.3 |
| 2007/0261366 | A1 * | 11/2007 | Iwamoto et al. | 53/136.1 |
| 2010/0043358 | A1 * | 2/2010 | Tsuruta et al. | 53/463 |

FOREIGN PATENT DOCUMENTS

| | | |
|---|---|---|
| EP | 2103526 A1 | 9/2009 |
| JP | 2004-142806 | 5/2004 |
| WO | 9413537 A1 | 6/1994 |

* cited by examiner

PACKAGING MACHINE

TECHNICAL FIELD

The present invention relates to a packaging machine, and particularly relates to a packaging machine in which a conveyed packaging material is formed into a tubular shape, articles are dropped into the tubular shape, and the packaging material is then laterally sealed with the articles packaged therein.

BACKGROUND ART

Vertical packaging machines are common as devices for packaging food products or other packaged articles by simultaneously manufacturing bags and loading packaged articles into the bags.

In the pillow packaging machine disclosed in Japanese Laid-open Patent Publication No. 2004-142806, a sheet packaging material is formed into a tubular shape by a former and a tube. A vertical joint of the tubular packaging material is vertically sealed by a vertical sealing means. The article is then loaded into the tubular packaging material, and a lateral seal is performed across the top part of the bag and the bottom part of the succeeding bag by a lateral sealing mechanism. The center of the laterally sealed portion is cut by a cutter.

SUMMARY OF THE INVENTION

Problems that the Invention is Intended to Solve

In packaging machines such as the one described above, the bag size must be reduced and the fill ratio increased in order to reduce packaging material cost and transportation cost. However, increasing the fill ratio leads to the risk of the packaged article fragmenting or becoming trapped in the sealed portion.

An object of the present invention is to provide a packaging machine whereby packaged articles can be prevented from fragmenting and becoming trapped in the sealed portion, and the fill ratio of packaged articles can be increased.

Means for Solving the Problems

A packaging machine according to a first aspect of the present invention is a packaging machine configured to drop articles into a packaging material formed in a tubular shape, seal the packaging material thereby making a bag with the articles packaged therein. The packaging machine includes a pair of sealing jaws and a pair of rotating brushes. The pair of sealing jaws hold the packaging material therebetween in a direction intersecting a conveyance direction of the packaging material and seal the packaging material. The pair of rotating brushes contact the packaging material while rotating, the rotating brushes being disposed upstream from the sealing jaws relative to the conveyance direction.

In this packaging machine, since the rotating brushes impart vibration to the articles, gaps between the articles aggregated in front of the sealing jaws are readily filled and the occupied space of the packaged articles is reduced. As a result, the bag size can be reduced.

A packaging machine according to a second aspect of the present invention is the packaging machine according to the first aspect, wherein the rotating brushes are operable to selectively hold the packaging material therebetween such that advancement of the articles is temporarily impeded by the rotating brushes, and the pair of rotating brushes are also selectively operable to release the packaging material such that the packaging material continues moving in the conveyance direction.

In this packaging machine, the articles to be packaged proceed into the packaging material as an elongated stream and therefore tend to accumulate on the bag bottom. Therefore, through a configuration in which the pair of rotating brushes holds the packaging material therebetween and impedes the advancement of the packaged articles, the elongated stream of packaged articles is allowed to accumulate at the leading end thereof. The accumulation of packaged articles is then timed and holding of the packaging material is released, and the packaged articles are thereby again conveyed in a more closely aggregated state than the aggregated state thereof when the advancement of the packaged articles was temporarily impeded. As a result, the space occupied by the packaged articles is reduced, and a smaller-sized bag can be used.

A packaging machine according to a third aspect of the present invention is the packaging machine according to the first or second aspect, wherein each of the rotating brushes defines a central axis and is operable for rotation about a rotational axis, the rotational axis being spaced apart by a predetermined distance from the central axis of each the rotating brushes.

In this packaging machine, the rotational axes are in a so-called eccentric arrangement whereby the rotating brushes swing, and small vibrations and large swings can thereby be simultaneously imparted to the packaged articles. Small vibrations and large swings cause the gaps between packaged articles to be readily filled and reduce the space occupied by the packaged articles. As a result, the bag size can be reduced.

A packaging machine according to a fourth aspect of the present invention is the packaging machine according to any of the first through third aspects, wherein bristles of the rotating brushes are made of resin.

In this packaging machine, since the bristles of the brushes are made of resin, the surface of the packaging material is unlikely to be damaged. Since the packaged articles also collide with the bristles of the brushes via the packaging material, the resin bristles have a cushioning effect that suppresses fragmentation of the packaged articles.

A packaging machine according to a fifth aspect of the present invention is the packaging machine according to any of the first through fourth aspects, wherein the rotating brushes have portions in which bristles are embedded at different densities.

Since there are various gaps between the packaged articles, imparting a constant vibration leaves a risk that some gaps will not be filled, but in this packaging machine, since there are localized variations in the density with which the bristles of the rotating brushes are embedded, the vibration transmitted to the tubular packaging material in contact with the bristles is complex, and the movements of the packaged articles are diversified. As a result, the packaged articles are easily packed together regardless of the shape of the gaps between the packaged articles.

Advantageous Effects of Invention

In the packaging machine of the present invention, since the rotating brushes impart vibration to the packaged articles, gaps between the packaged articles aggregated in front of the sealing jaws are readily filled and the occupied space of the packaged articles is reduced. As a result, the bag size can be reduced.

DESCRIPTION OF EMBODIMENT

Embodiments of the present invention are described below with reference to the accompanying drawings. The embodiments described below are specific examples of the present invention and do not limit the technical scope of the present invention.

(1) Configuration of the Packaging Machine 1

Figure 1:
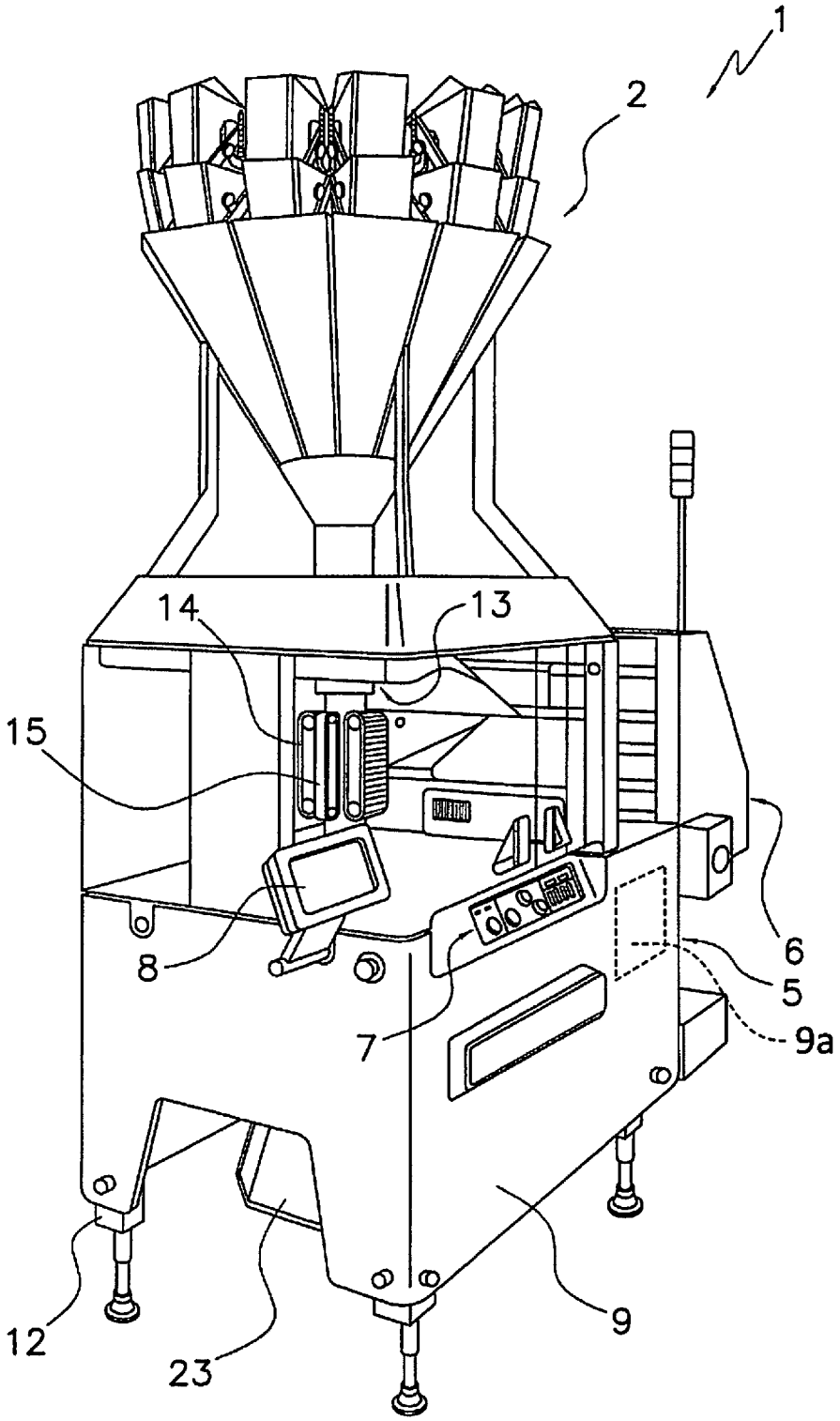
FIG. 1 is a perspective view showing a packaging machine according to an embodiment of the present invention.
Figure 2:
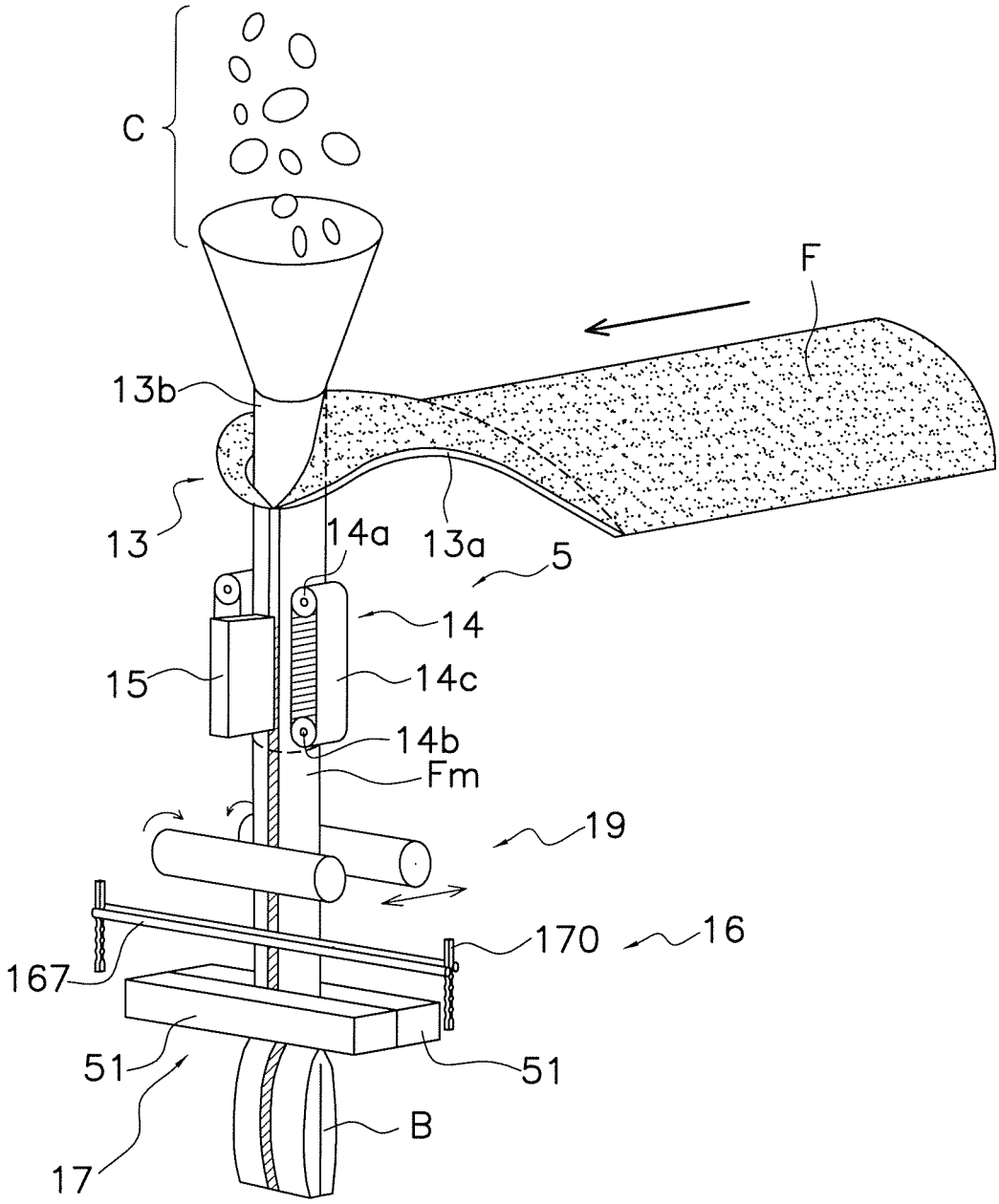
FIG. 2 is a perspective view showing the overall configuration of a bag-making and packaging unit of the packaging machine.

FIG. 1 is a perspective view showing a packaging machine according to an embodiment of the present invention. FIG. 2 is a perspective view showing the overall configuration of a bag-making and packaging unit of the packaging machine. In FIGS. 1 and 2, the packaging machine 1 is provided with a combination weighing device 2, a bag-making and packaging unit 5, and a film feeding unit 6.

The combination weighing device 2 weighs a packaged article and discharges a predetermined total weight thereof. The bag-making and packaging unit 5 is a main component for packing the packaged articles into bags. The film feeding unit 6 feeds a film F for forming bags to the bag-making and packaging unit 5.

Operating switches 7 are provided on a front surface of the bag-making and packaging unit 5. A touch-panel display 8 for displaying operating states is positioned so as to be visible to a worker operating the operating switches 7.

The combination weighing device 2, the bag-making and packaging unit 5, and the film feeding unit 6 are controlled in accordance with operations and settings inputted from the operating switches 7 and the touch-panel display 8. The operating switches 7 and the touch-panel display 8 are connected to a controller 9*a* composed of a CPU, ROM, RAM, and other components, and the controller 9*a* takes in necessary information from various sensors provided to the combination weighing device 2 and the bag-making and packaging unit 5 and uses the information in various types of control.

(2) Detailed Configuration (2-1) Combination Weighing Device 2

The combination weighing device 2 is disposed on top of the bag-making and packaging unit 5, and after products C are weighed in a weighing hopper, the combination weighing device 2 combines the weighed values to achieve a predetermined total weight and sequentially discharges the products.

(2-2) Film Feeding Unit 6

The film feeding unit 6 is a unit for feeding a sheet film F to a forming mechanism 13 of the bag-making and packaging unit 5, and is provided adjacent to the bag-making and packaging unit 5. A roll on which the film F is wound is set in the film feeding unit 6, and the film F is unwound from the roll.

(2-3) Bag-making and Packaging Unit 5

Figure 8:
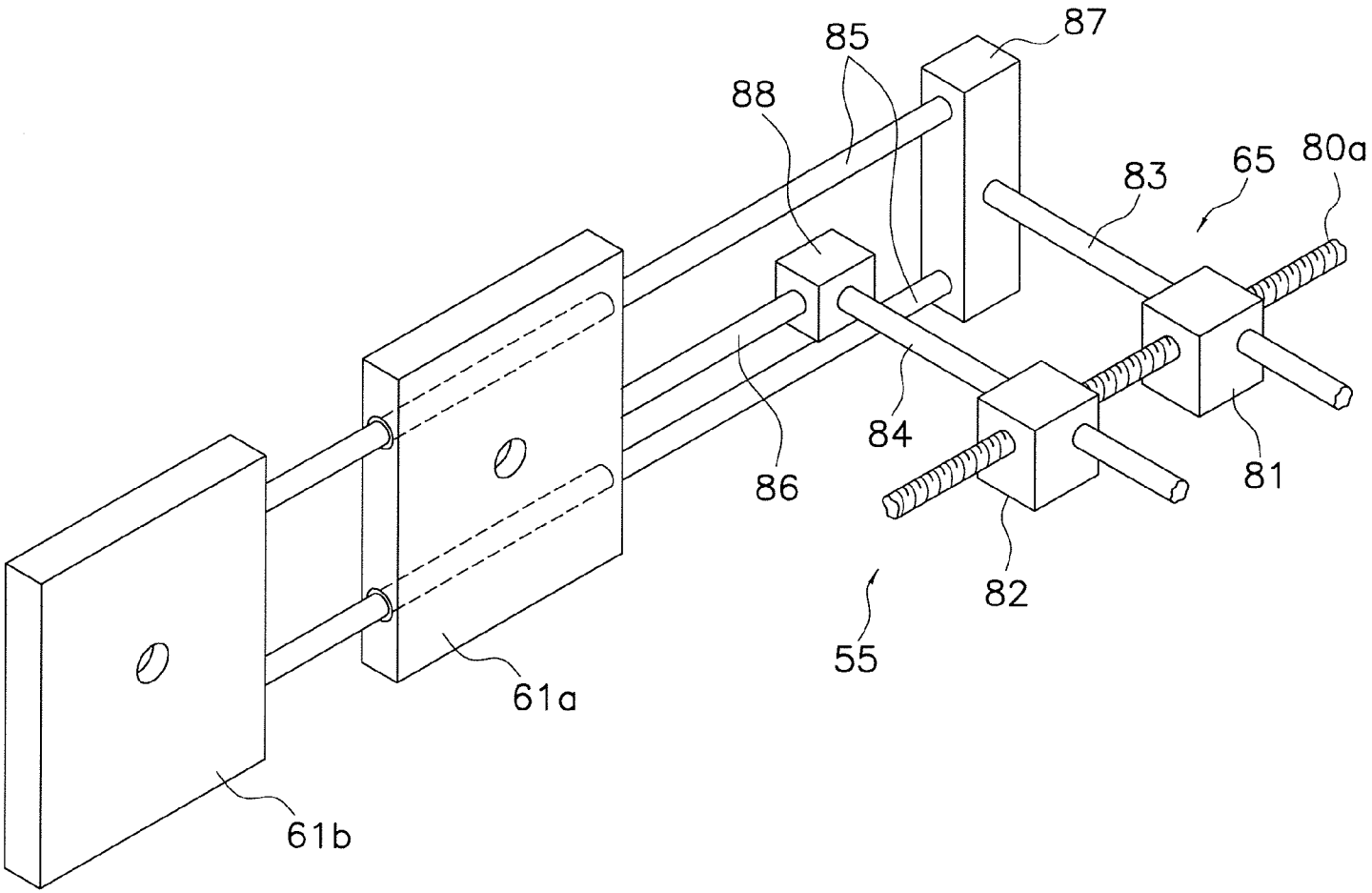
FIG. 8 is an external perspective view showing a lateral drive mechanism of the sealing jaws.

As shown in FIGS. 1 and 2, the bag-making and packaging unit 5 is composed of the forming mechanism 13, a pull-down belt mechanism 14, a vertical sealing mechanism 15, a shutter mechanism 16, a lateral sealing mechanism 17, a vibration-imparting mechanism 19, and a lateral drive mechanism 55 (refer to FIG. 8).

The forming mechanism 13 forms the film F conveyed in the form of a sheet into a tubular shape. The pull-down belt mechanism 14 conveys the tubular film F (hereinafter referred to as the tubular film Fm) downward. The vertical sealing mechanism 15 seals overlapping portions (joints) of the tubular film Fm in the vertical direction.

The shutter mechanism 16 holds the top part of the tubular film Fm therebetween to prevent the packaged article from being trapped in the sealed part before the sealed part is sealed by the lateral sealing mechanism 17, and the shutter mechanism 16 oscillates with the tubular film Fm in the clamped state.

The lateral sealing mechanism 17 seals the top and bottom ends of the bag closed by sealing the tubular film Fm in the lateral direction. The vibration-imparting mechanism 19 imparts vibration to the tubular film Fm. The lateral drive mechanism 55 causes the shutter mechanism 16 and the lateral sealing mechanism 17 to move in reciprocating fashion. These mechanisms are supported by a support frame 12. The area surrounding the support frame 12 is covered by a casing 9.

(2-3-1) Forming Mechanism 13

The forming mechanism 13 has a former 13*a* and a tube 13*b*. The tube 13*b* is a member extending in the vertical direction, a portion of the tube 13*b* being formed in a tubular shape, and the top and bottom ends thereof are open. The products C weighed by the combination weighing device 2 are placed in the opening at the top end of the tube 13*b*. The former 13*a* is provided so as to surround the tube 13*b*. The sheet film F unwound from the film roll is formed into a tubular shape as the sheet film F passes between the former 13*a* and the tube 13*b*. The former 13*a* and tube 13*b* of the forming mechanism 13 can be replaced according to the size of the bags to be manufactured.

(2-3-2) Pull-Down Belt Mechanism 14

As shown in FIG. 2, the pull-down belt mechanism 14 is a mechanism for adhering to the tubular film Fm wrapped around the tube 13*b* and continuously conveying the tubular film Fm downward, and is provided with belts 14*c* on the left and right sides of the tube 13*b*. In the pull-down belt mechanism 14, belts 14*c* having adhesive capability are rotated by drive rollers 14*a* and following rollers 14*b*, and the tubular film Fm is thereby carried downward. In FIG. 2, a roller drive motor for rotating the drive rollers 14*a* and the like are not shown.

(2-3-3) Vertical Sealing Mechanism 15

The vertical sealing mechanism 15 is a mechanism for vertically sealing the overlapping portion of the tubular film Fm wrapped around the tube 13*b* by heating the overlapping portion while pushing the overlapping portion against the tube 13*b* with a certain pressure. The vertical sealing mechanism 15 is positioned in front of the tube 13*b*, and has a heater and a heater belt that is heated by the heater and placed in contact with the overlapping portion of the tubular film Fm. The vertical sealing mechanism 15 is also provided with a drive device (not shown in the drawings) for moving the heater belt toward and away from the tube 13*b*.

(2-3-4) Vibration-imparting Mechanism 19

Figure 3:
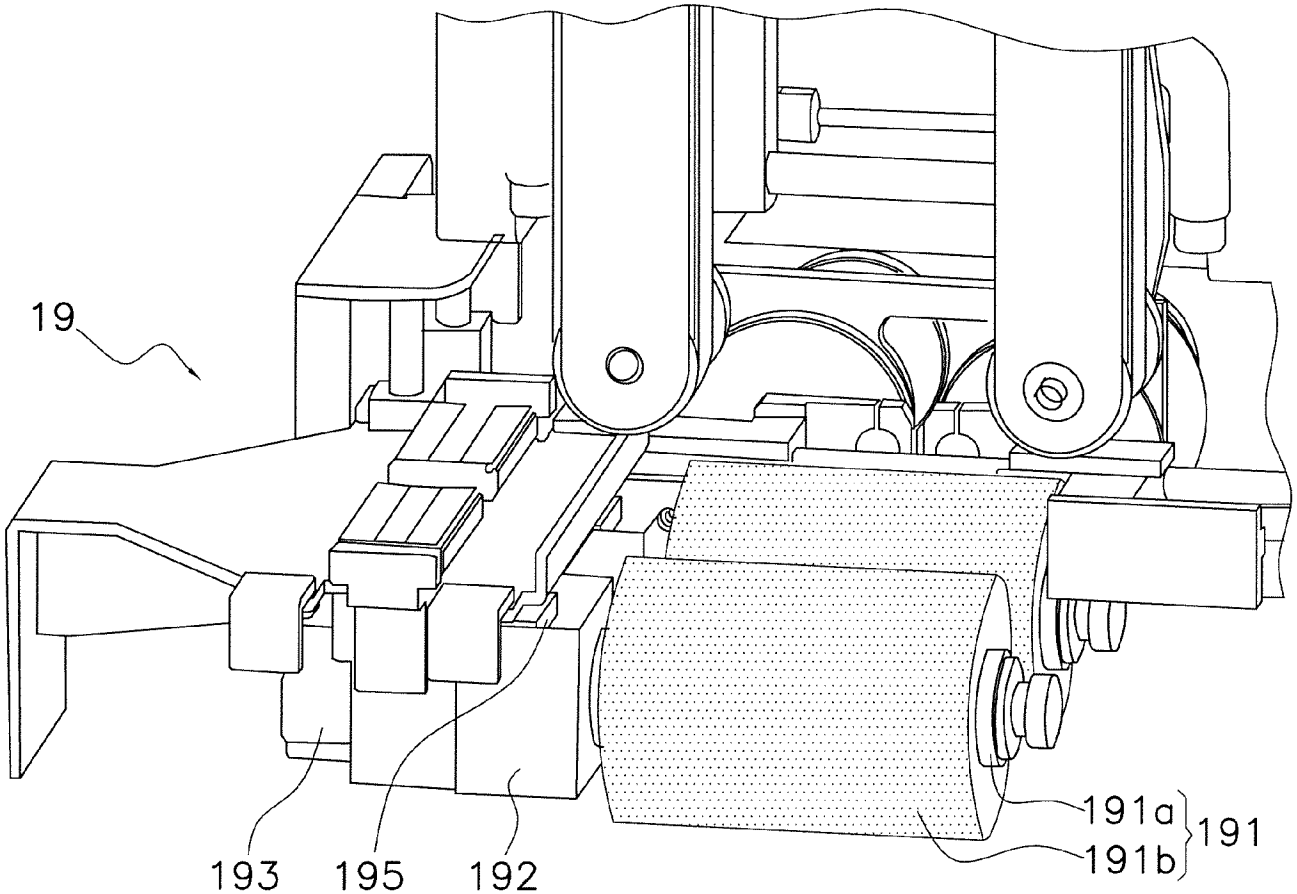
FIG. 3 is a perspective view showing a vibration-imparting mechanism of the packaging machine.

As shown in FIG. 2, the vibration-imparting mechanism 19 is positioned above the shutter mechanism 16 and the lateral sealing mechanism 17. FIG. 3 is a perspective view showing the vibration-imparting mechanism. In FIG. 3, the vibration-imparting mechanism 19 is composed of a pair of cylindrical brushes 191, a motor 193 for rotating the brushes 191, and an air cylinder 195 for moving the brushes 191 horizontally.

The pair of brushes 191 face each other and hold the tubular film Fm therebetween. The brushes 191 are formed by embedding resin bristles 191*b* in a cylindrical core 191*a*. The core 191*a* is attached to a rotary shaft of the motor 193 via a joint 192. Each of the brushes 191 defines a central axis. The rotary shaft of the motor 193 defines a rotational axis. The brushes 191 are attached so that the rotary shaft of the motor 193 (the rotational axis) and the central axis of the core 191*a* are spaced apart from one another by a predetermined distance, and the pair of brushes 191 are rotated by the driving of the motor 193 while being moved toward or apart from each other. Since the brushes 191 and the tubular film Fm are in contact with each other, the tubular film Fm is vibrated by the rotation of the brushes 191.

The air cylinder 195 moves the brushes 191 and the motor 193 integrally with each other. The pair of brushes 191 can be moved by the air cylinder 195 in repeated reciprocal motion so as to alternate between moving toward each other in the direction of holding the tubular film Fm therebetween and moving in the direction away from each other.

The predetermined quantity of packaged articles dropped from above the tube 13*b* generally passes into the tubular film Fm as a vertical stream, and is therefore prone to become bulky in the vertical direction. However, when the packaged articles are dropped while the tubular film Fm is being held between the brushes 191, the advancement of the leading end of the vertical stream of packaged articles is impeded, and the distance between the leading end and the trailing end is reduced. The vibration created by the rotation of the brushes 191 is also transmitted to the packaged articles, the gaps between packaged articles are filled, and an aggregation is formed in which the occupied space is further reduced.

Since the rotation and reciprocal movement of the brushes 191 creates a rotation which sends articles in the conveyance direction while vibrating the point of contact of the brushes 191 and the tubular film Fm, the aggregated packaged articles are sent toward the lateral sealing mechanism 17 when the brushes 191 move apart from each other.

(2-3-5) Shutter Mechanism 16

The shutter mechanism 16 holds the top of the sealed portion of the tubular film Fm therebetween immediately in front of the lateral seal and stops the packaged articles so that packaged articles or fragments thereof are not trapped in the sealed part during lateral sealing of the tubular film Fm. The shutter mechanism 16 repeatedly alternates between a first state of holding the tubular film Fm therebetween and descending, and a second state of moving away from the tubular film Fm until again holding the tubular film Fm therebetween.

Figure 4A:
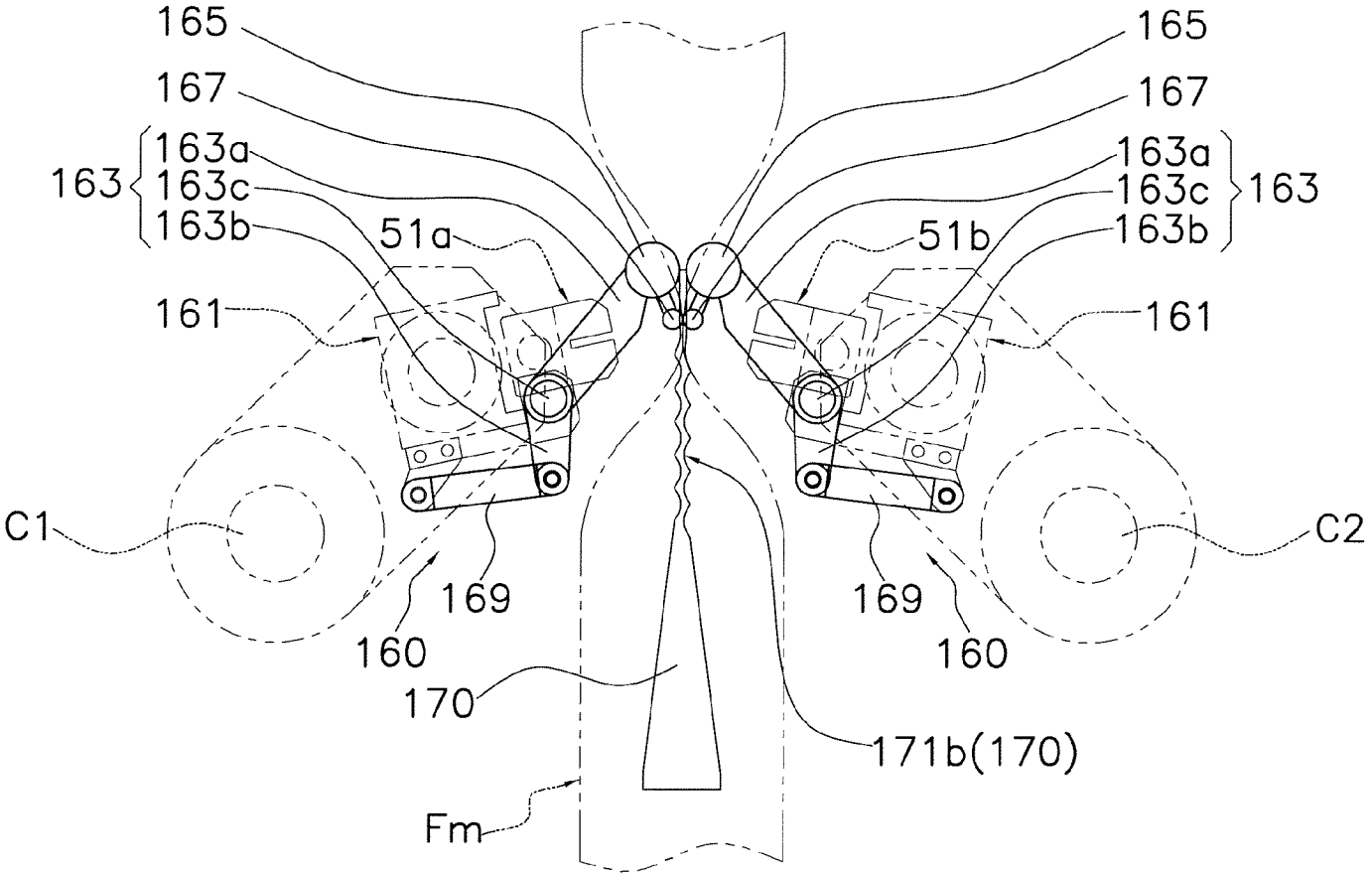
FIG. 4A is a side view showing a shutter mechanism of the packaging machine immediately before a first state.
Figure 4B:
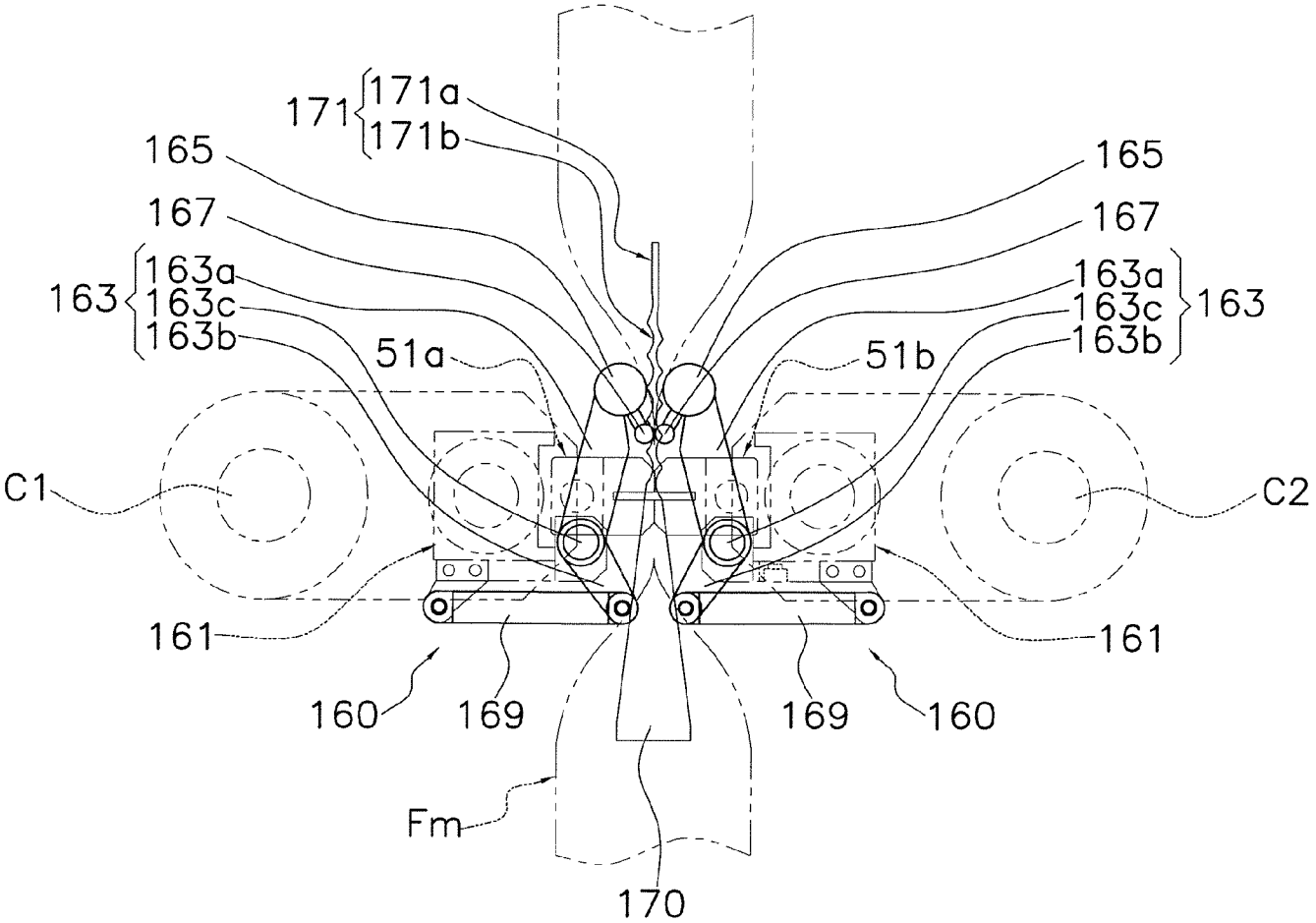
FIG. 4B is a side view showing the shutter mechanism in the first state.
Figure 4C:
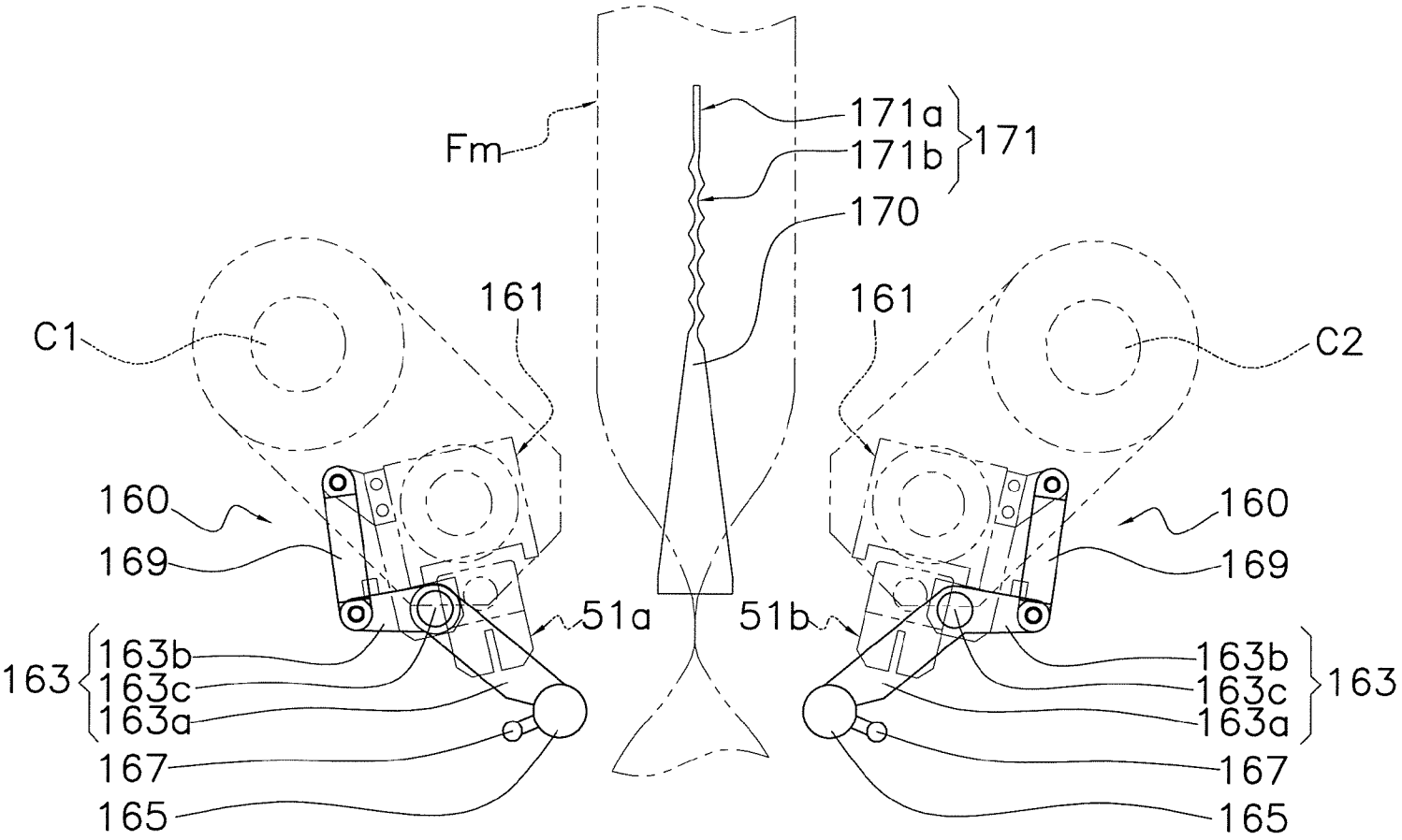
FIG. 4C is a side view showing the shutter mechanism in a second state.

FIG. 4A is a side view showing the shutter mechanism immediately before the first state. FIG. 4B is a side view showing the shutter mechanism in the first state. FIG. 4C is a side view showing the shutter mechanism in the second state. In FIGS. 4A, 4B, and 4C, sealing jaws 51 are indicated by dashed-dotted lines to facilitate understanding of the relationship between the shutter mechanism 16 and the lateral sealing mechanism 17.

As shown in FIG. 4A, the shutter mechanism 16 is composed of a shutter cam 170 and a pair of mechanisms 160 which move along a cam surface of the shutter cam 170. The mechanisms 160 are each composed of a supporting member 161, a linking member 163, a roller 165, a shutter member 167, and a spring member 169.

The shutter cam 170 has a cam surface 171 which includes a flat surface 171*a* and a waved surface 171*b*, over which the roller 165 is driven.

The supporting members 161 are members for supporting sealing jaws 51*a*, 51*b*, and the supporting members 161 also support the linking members 163 so as to allow the linking member 163 to rotate.

In each linking member 163, a long link 163*a* and a short link 163*b* are connected in a V shape, and a connecting part 163*c* thereof is rotatably supported by the supporting member 161. A roller 165 and a shutter member 167 are attached to a distal end of each long link 163*a*. One end of each spring member 169 is also connected to a distal end of a short link 163*b*, and the other end of each spring member 169 is fixed to a supporting member 161. Consequently, the linking member 163 is urged by the urging force of the spring member 169 in the direction in which the distal ends of the pair of long links 163*a* approach each other.

The rollers 165 are attached so as to be able to rotate at the distal ends of the long links 163*a* of the linking members 163. The rollers 165 roll along the cam surface 171 of the shutter cam 170 during the period before and after lateral sealing. The cam surface 171 includes a flat surface 171*a* that extends a first distance in the conveyance direction of the tubular film Fm, and a waved surface 171*b* that extends a second distance after the flat surface 171*a*.

When the rollers 165 roll over the flat surface 171*a*, the pair of shutter members 167 descend the first distance vertically while holding the tubular film Fm therebetween. When the rollers 165 roll over the waved surface 171*b*, the pair of shutter members 167 descend the second distance while oscillating and holding the tubular film Fm therebetween.

For convenience in the description, the zone in which the rollers 165 roll over the flat surface 171*a* is referred to as the first zone, and the zone in which the rollers 165 roll over the waved surface 171*b* is referred to as the second zone. Lateral sealing of the tubular film Fm is performed when the pair of rollers 165 is in the first zone. When the pair of rollers 165 is in the second zone, the tubular film Fm oscillates in a direction which intersects with the conveyance direction and the lateral direction.

The shutter members 167 are longer than the width of the tubular film Fm, and both ends thereof are fixed at the distal ends of the long links 163*a* of the linking members 163. The pair of shutter members 167 hold the tubular film Fm therebetween earlier than the sealing jaws 51, and prevent the packaged articles from falling above the sealed portion during lateral sealing of the tubular film Fm. At least the portion of the shutter members 167 that holds the tubular film Fm therebetween is a coil spring.

(2-3-6) Lateral Sealing Mechanism 17

Figure 5:
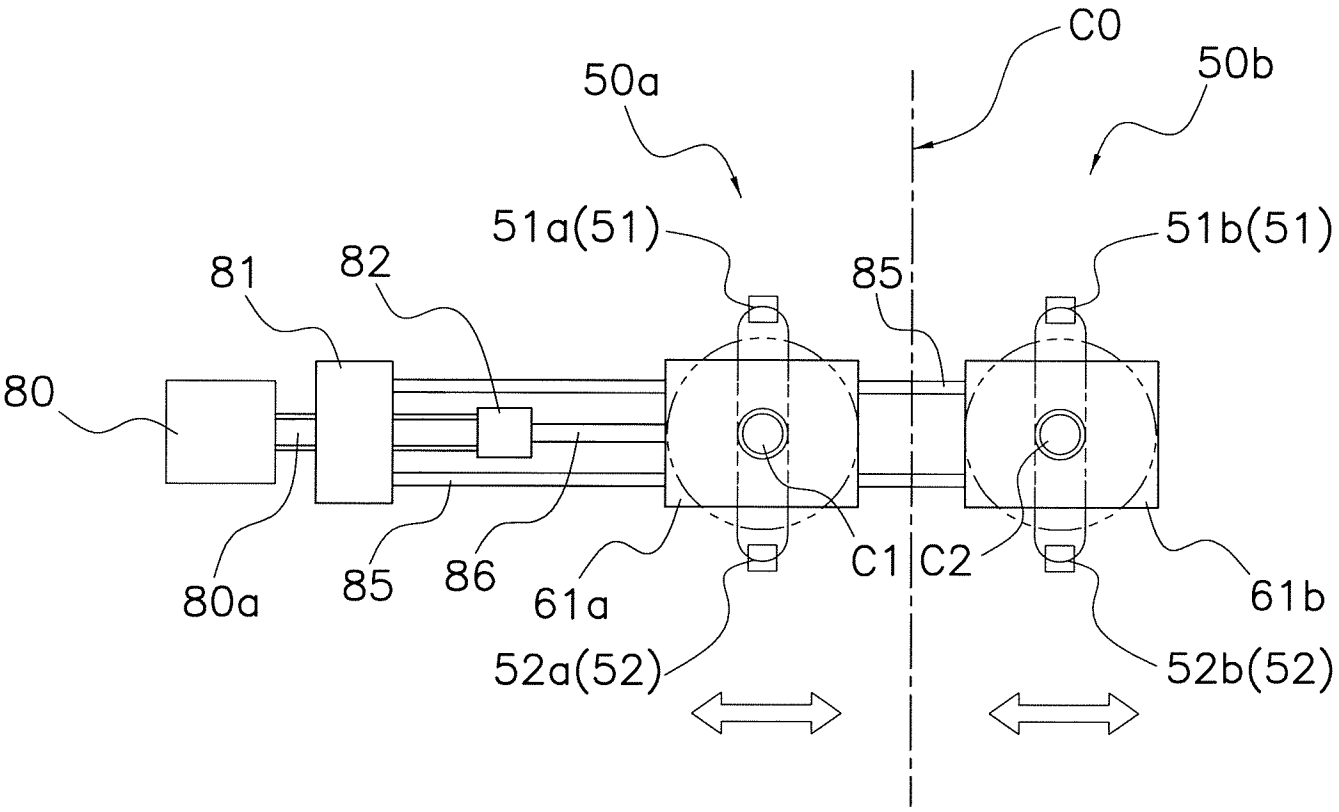
FIG. 5 is a side view showing a lateral sealing mechanism of the packaging machine, the lateral sealing mechanism including sealing jaws.
Figure 6:
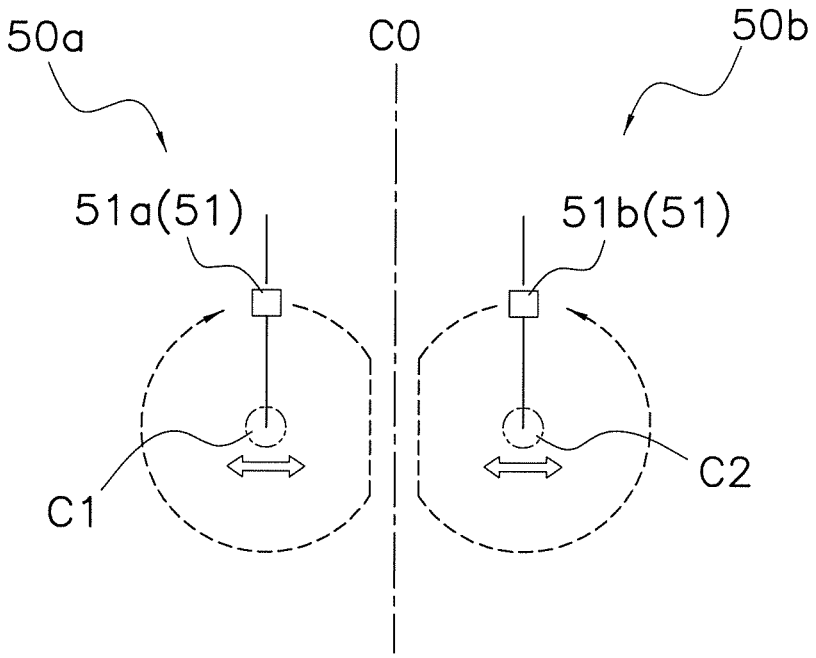
FIG. 6 is a side view showing a trajectory of the sealing jaws.

FIG. 5 is a side view showing the lateral sealing mechanism. FIG. 6 is a side view showing the trajectory of the sealing jaws. As shown in FIG. 5, the lateral sealing mechanism 17 has a first sealing mechanism 50*a* and a second sealing mechanism 50*b*. The sealing mechanism positioned to the left of the tubular film Fm in FIG. 5 is the first sealing mechanism 50*a*, and the sealing mechanism positioned to the right of the tubular film Fm is the second sealing mechanism 50*b*.

The first sealing mechanism 50*a* and second sealing mechanism 50*b* hold the tubular film Fm therebetween while causing the sealing jaws 51, 52, respectively, to turn in a D shape (see, for example, the trajectory of the sealing jaws indicated by dotted lines in FIG. 6).

The sealing jaws 51, 52 have heaters in the inside thereof. Sealing surfaces of the sealing jaws 51, 52 are heated by the heaters, and a portion of the tubular film Fm held between the sealing jaws 51, 52 is thereby sealed.

For convenience in this description, the sealing jaw 51 on the side of the first sealing mechanism 50*a* is referred to as the first sealing jaw 51*a*, and the sealing jaw 51 on the side of the second sealing mechanism 50*b* is referred to as the second sealing jaw 51*b*. The first sealing jaw 51*a* and the second sealing jaw 51*b* hold the tubular film Fm therebetween and press against each other to form a seal.

In the same manner, the sealing jaw 52 on the side of the first sealing mechanism 50*a* is referred to as the first sealing jaw 52*a*, and the sealing jaw 52 on the side of the second sealing mechanism 50*b* is referred to as the second sealing jaw 52*b*. The first sealing jaw 52*a* and the second sealing jaw 52*b* hold the tubular film Fm therebetween and press against each other to form a seal.

The term "sealing jaws 51, 52" is used when referring to components that are common to both sealing jaws.

The sealing jaws 51, 52 are rotated about axes C1, C2 by a drive motor (not shown). Specifically, the first sealing jaws 51*a*, 52*a* are rotated about the axis C1, and the second sealing jaws 51*b*, 52*b* are rotated about the axis C2.

Figure 7:
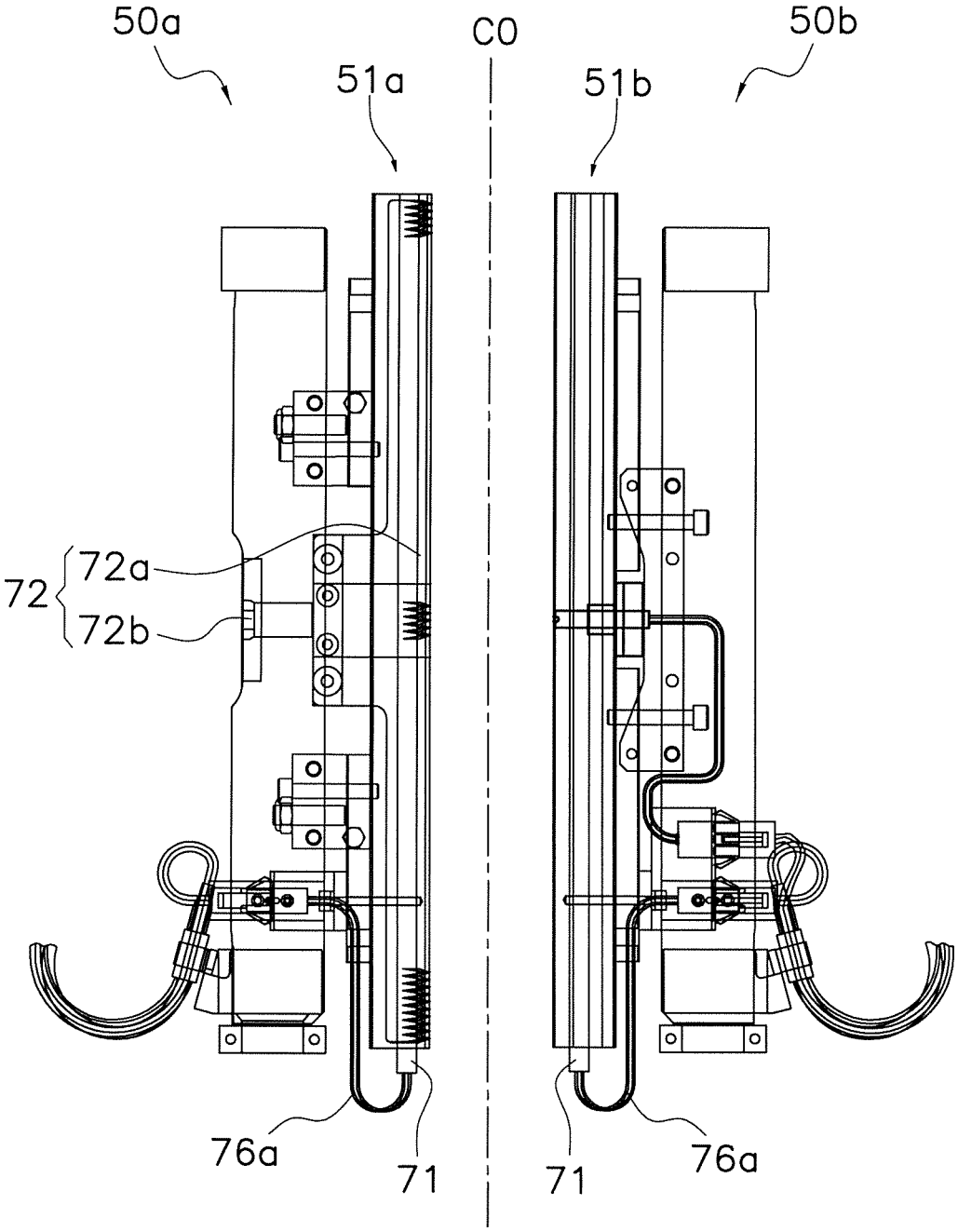
FIG. 7 is a plan view showing the area around the sealing jaws.

FIG. 7 is a plan view showing the area around the sealing jaws. In FIG. 7, heaters 71 and a cutting mechanism 72 are built into the sealing jaws 51. The heaters 71 are inserted two each into the first sealing jaw 51*a* and the second sealing jaw 51*b* in the longitudinal direction thereof. The heaters 71 receive electrical power from electrical wiring 76*a* to generate heat, and heat the first sealing jaw 51*a* and second sealing jaw 51*b* to a sealing temperature that corresponds to the tubular film Fm.

The cutting mechanism 72 is provided to the first sealing jaw 51*a* on the side of the first sealing mechanism 50*a*, and has a cutter 72*a* and a cutter driving mechanism 72*b*. In accordance with the sealing timing of the tubular film Fm, the cutter 72*a* is advanced by the cutter driving mechanism 72*b* toward the second sealing jaw 51*b* from inside a slide space formed in the first sealing jaw 51*a*.

An air cylinder is employed in the cutter driving mechanism 72*b* to reciprocally move the cutter 72*a* in a predetermined direction. Therefore, between the first sealing jaw 51*a* and the second sealing jaw 51*b*, or between the first sealing jaw 52*a* and the second sealing jaw 52*b*, the cutter 72*a* presses on the position of the sealed portion substantially at the center in the width direction thereof, and the sealed portion is cut. As a result, one bag at a time is separated off and discharged to a chute conveyor 23 (refer to FIG. 1).

(2-3-7) Lateral Drive Mechanism 55

FIG. 8 is an external perspective view showing the lateral drive mechanism of the sealing jaws. In FIG. 8, the first sealing mechanism 50*a* is supported by a first horizontal movement plate 61*a*, and the second sealing mechanism 50*b* is supported by a second horizontal movement plate 61*b*. The first horizontal movement plate 61*a* and the second horizontal movement plate 61*b* are moved horizontally by the lateral drive mechanism 55.

As shown in FIG. 8, the lateral drive mechanism 55 has a drive mechanism 65 for moving the first horizontal movement plate 61*a* and the second horizontal movement plate 61*b* toward or away from each other.

The drive mechanism 65 has a ball screw 80*a*, a first nut 81, a second nut 82, a first connecting rod 83, a second connecting rod 84, third connecting rods 85, and a fourth connecting rod 86.

The ball screw 80*a* is rotated by a servo motor. The first nut 81 and the second nut 82 are screwed onto the ball screw 80*a*. The first connecting rod 83 and the second connecting rod 84 are provided so as to be orthogonal to the ball screw 80*a* in the horizontal direction. The third connecting rods 85 are provided in the direction of movement of the first horizontal movement plate 61*a* and the second horizontal movement plate 61*b*. The fourth connecting rod 86 is provided parallel to the third connecting rods 85.

The first connecting rod 83 is connected to the third connecting rods 85 via a joint 87, and distal ends of the third connecting rods 85 are fixed to a lateral end surface of the second horizontal movement plate 61*b*. The third connecting rods 85 are passed through the first horizontal movement plate 61*a* so as to be able to slide.

The second connecting rod 84 is connected to the fourth connecting rod 86 via a joint 88, and a distal end of the fourth connecting rod 86 is fixed to a lateral end surface of the first horizontal movement plate 61*a*.

The portion of the ball screw 80*a* on which the first nut 81 is screwed and the portion of the ball screw 80*a* on which the second nut 82 is screwed are threaded in opposite directions.

Through the drive mechanism 65 described above, the first horizontal movement plate 61*a* and the second horizontal movement plate 61*b* can be moved toward or away from each other by rotation of the ball screw 80*a*.

(3) Operation of the Packaging Machine 1

The sequence of operations of the packaging machine 1 will next be described. Packaged articles (hereinafter referred to as products C) weighed by the combination weighing device 2 are sequentially dropped into the top open end of the tube 13*b*. At this time, the outer periphery of the tube 13*b* is covered by the tubular film Fm for packaging the products C.

The products C pass through the tube 13*b*, and are discharged from the bottom open end of the tube 13*b*. Below the bottom open end, the pair of brushes 191 hold the tubular film Fm therebetween and temporarily block the passage of the products C.

Figure 9:
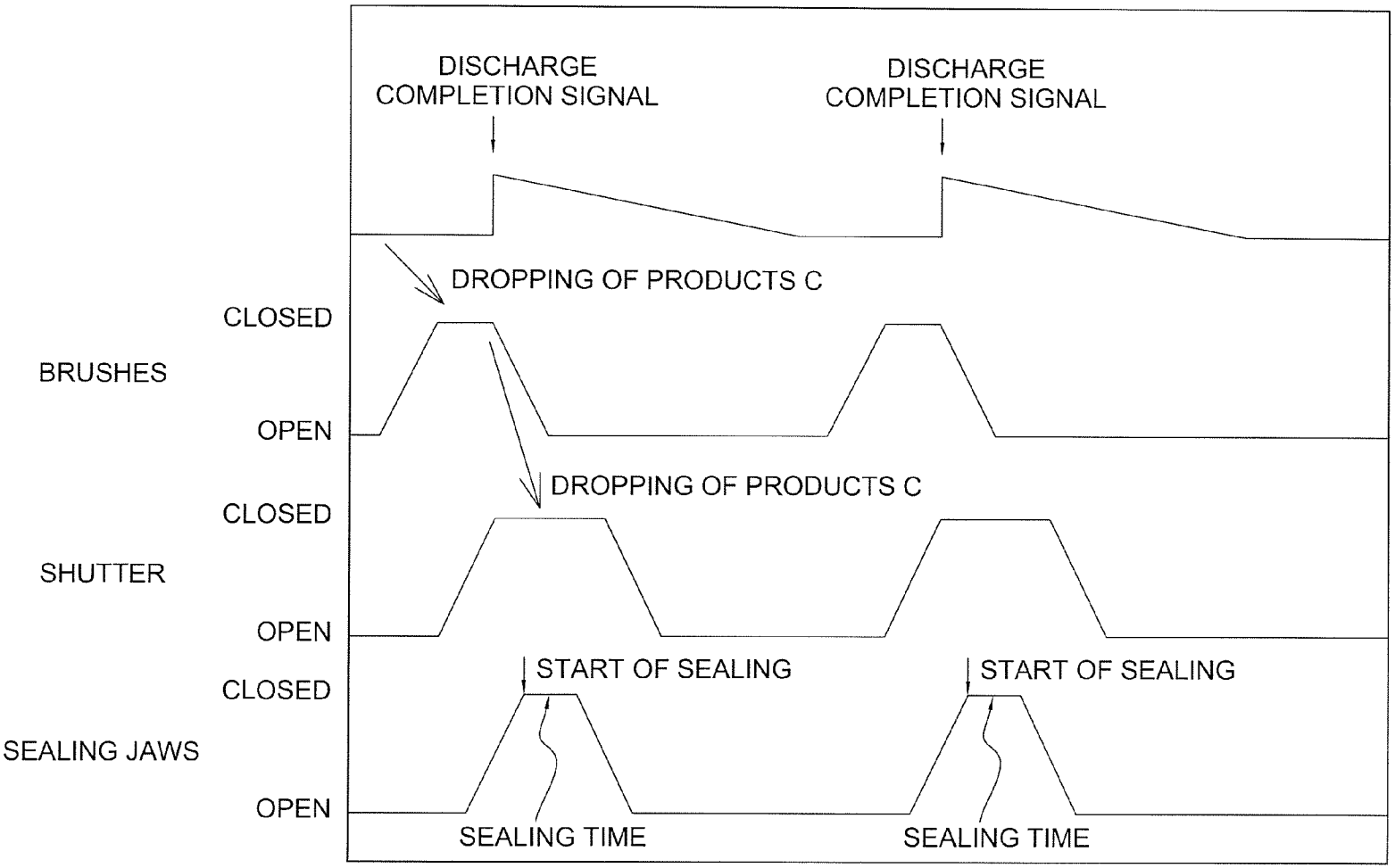
FIG. 9 is a chart showing synchronization of movements of the packaging machine, with the periods of discharge of the products, opening and closing of brushes of the vibration-imparting mechanism, opening and closing of the shutter mechanism, and opening and closing of the sealing jaws being depicted graphically.

FIG. 9 is a chart showing synchronized operation of the periods of discharge of the products C, opening and closing of the brushes, opening and closing of the shutter, and opening and closing of the sealing jaws. Here, "closed" means that the tubular film Fm is held closed so that products C are not allowed to pass through, and "open" means that the closing off of the tubular film Fm is released and products C are allowed to pass through.

In FIG. 9, the brushes 191 are closed from before the products C are dropped, and the brushes 191 begin to open when the controller 9*a* receives a signal (discharge completion signal) indicating that products C have been discharged from the combination weighing device 2. Therefore, the period during which advancement of the products C is stopped by the brushes 191 is short. During this short period, the distance between the leading end and the trailing end of the products C advancing as a vertical stream is reduced, vibration created by rotation of the brushes 191 is transmitted to the packaged articles, and the gaps between products C are filled. The brushes 191 move apart from each other and send out the products C while vibrating the tubular film Fm by the rotation and reciprocal movement.

In FIG. 9, since the shutter members 167 are closed from before the brushes 191 begin to open, the products C are stopped between the brushes 191 and the shutter members 167, and during this time, the products C are vibrated by the rotation of the brushes 191 so that the gaps between the products C are further filled. The shutter members 167 descend the first distance vertically in the closed state, and then descend the second distance while oscillating. The oscillation of the shutter members 167 is transmitted to the products C, and the gaps between the products C are further filled.

In FIG. 9, while the shutter members 167 are closed, the first sealing jaw 51*a* and the second sealing jaw 51*b* hold and laterally seal the tubular film Fm therebetween, the tubular film Fm being positioned below the shutter members 167. Lateral sealing is performed while the shutter members 167 descend the first distance, the top part of a bag and the bottom part of the succeeding bag are formed, the center of the sealed part is simultaneously cut, and a bag packed with products C is completed.

(4) Characteristic Features (4-1)

In the packaging machine 1, the pair of brushes 191 hold the tubular film Fm therebetween while rotating, and impede the advancement of the packaged articles, and the elongated stream of packaged articles thereby aggregates at the leading end thereof. Holding of the tubular film Fm is then released, and the packaged articles are again conveyed in a more closely aggregated state than the aggregated state thereof when the advancement of the packaged articles was temporarily impeded. As a result, the space occupied by the packaged articles is reduced, and a smaller-sized bag can be used.

(4-2)

The rotational axis of each brush 191 is biased a predetermined distance from the central axis of the core 191*a* thereof. Since the brushes 191 swing in conjunction with the rotation thereof, small vibrations and large swings cause the gaps between packaged articles to be readily filled and reduce the space occupied by the packaged articles. As a result, the bag size can be reduced.

(4-3)

Since the bristles 191*b* of the brushes 191 are made of resin, the surface of the tubular film Fm is unlikely to be damaged. Since the packaged articles also collide with the bristles 191*b* of the brushes 191 via the tubular film Fm, the resin bristles 191*b* have a cushioning effect that suppresses fragmentation of the packaged articles.

(4-4)

Since there are localized variations in the density with which the bristles 191*b* of the brushes 191 are embedded in the core 191*a*, the vibration transmitted to the tubular film Fm in contact with the bristles 191*b* is complex, and the movements of the packaged articles are diversified. As a result, the gaps between packaged articles are easily filled regardless of the shape of the gaps between the packaged articles.

(5) Modifications (5-1) Modification 1

In the embodiment described above, the bristles 191*b* of the brushes 191 are embedded uniformly over the entire area of the cores 191*a*, but this configuration is not limiting. Modes for embedding the bristles 191*b* are described below with reference to the accompanying drawings.

Figure 10A:
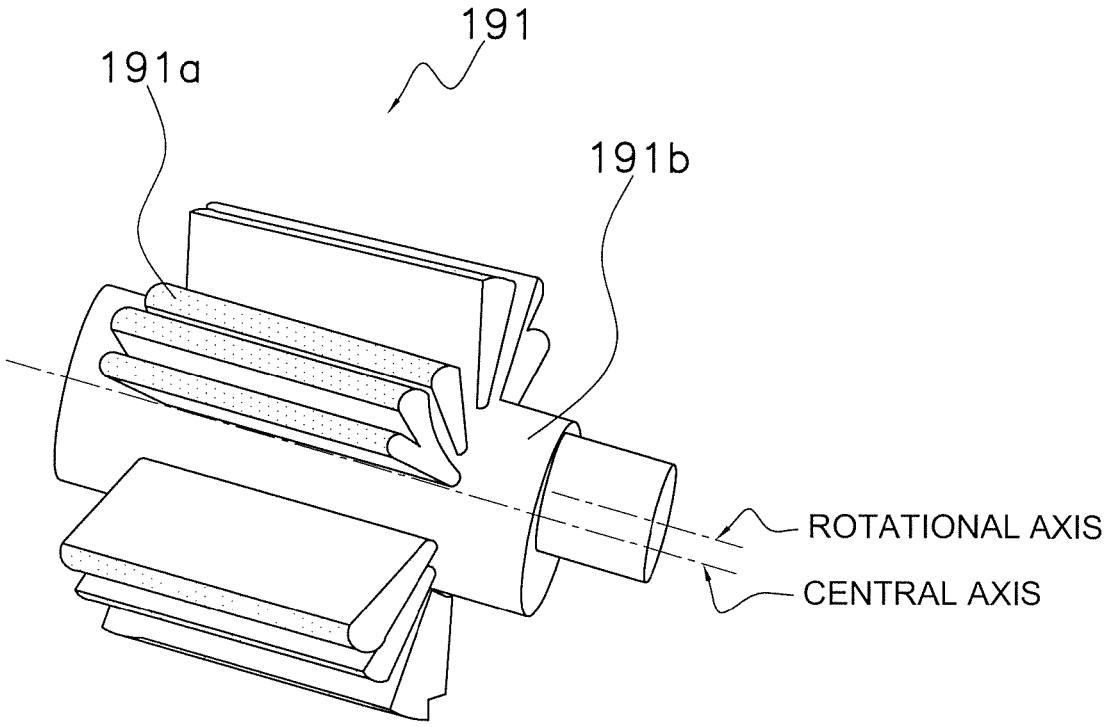
FIG. 10A is a perspective view showing one of the brushes of the vibration-imparting mechanism, with a central axis being offset from a rotational axis thereof.
Figure 10B:
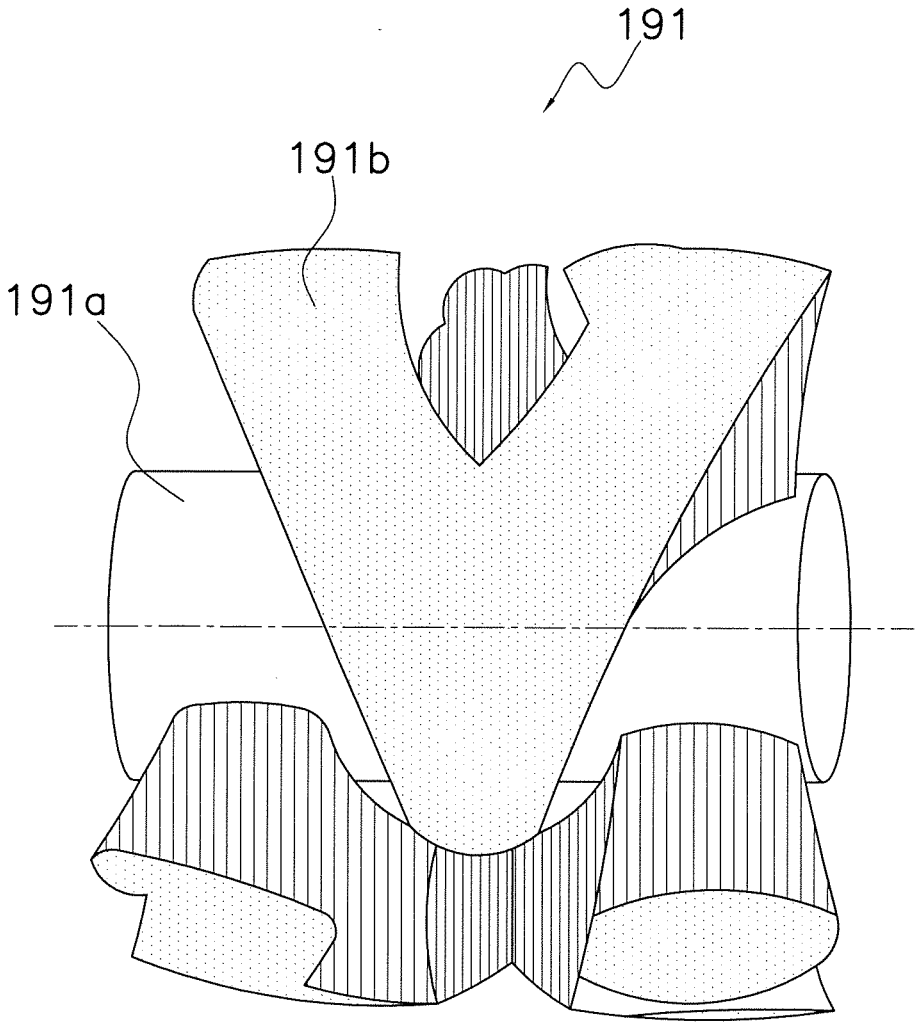
FIG. 10B is a perspective view showing another embodiment of a brush of the vibration-imparting mechanism.

FIGS. 10A and 10B are perspective views showing another brush. In FIG. 10A, the bristles 191*b* of a brush 191 are embedded so that non-dense and dense states repeat at equal intervals around the core 191*a*. The non-dense state of the bristles 191*b* of the brush 191 also includes a state in which there are no bristles 191*b*.

By varying the density with which the bristles 191*b* are embedded in the brush 191, the amplitude of the vibration transmitted to the tubular film Fm in contact with the bristles 191*b* is increased, and the gaps between packaged articles are more readily filled.

In FIG. 10B, the bristles 191*b* of the brush 191 are embedded so as to create a spiral toward both ends from the center of the core 191*a*. As this brush 191 rotates, the vibration component propagated to both ends in the lateral direction from the center of the tubular film Fm increases, and the packaged articles are made even toward both ends in the lateral direction. The manner in which the bristles 191*b* are embedded is selected according to the type of packaged articles.

(5-2) Modification 2

An elliptical cross-sectional shape is generally maintained in the tubular film Fm in the zone in which the tubular film Fm is in contact with the tube 13*b*, but the shape flattens as the tubular film Fm proceeds downstream from the bottom open end of the tube 13*b*, and clogging with packaged articles is prone to occur in the vicinity of the bottom open end.

In the packaging machine of the present modification, in order to prevent clogging with packaged articles in the vicinity of the bottom open end, air is blown from both sides in the lateral direction of the tubular film Fm to prevent flattening of the tubular film.

Figure 11:
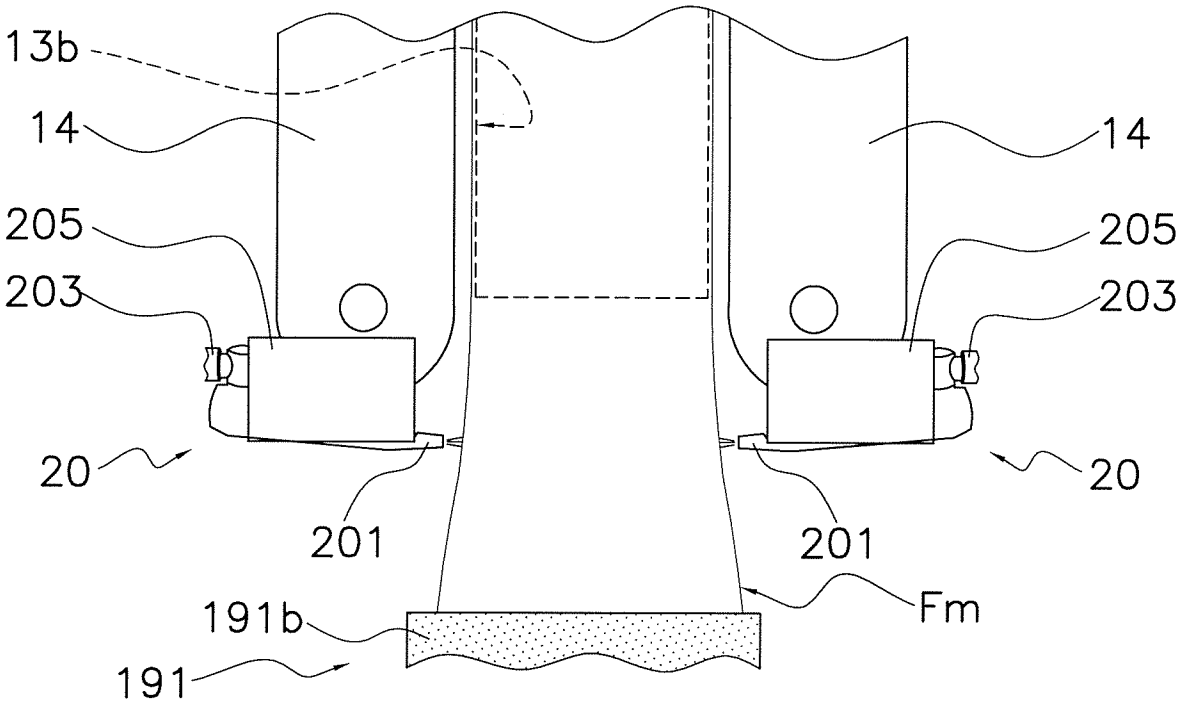
FIG. 11 is a front view showing the air blowing mechanism of the packaging machine according to a modification.

FIG. 11 is a front view showing the air blowing mechanism of the packaging machine of the present modification. In FIG. 11, air blowing mechanisms 20 are composed of a pair of air nozzles 201, air hoses 203, and attachment plates 205. The air nozzles 201 forming a pair are fixed to the attachment plates 205 so that the distal ends thereof are adjacent to the tubular film Fm. The distal ends of the air nozzles 201 face the center from both sides of the tubular film Fm in the lateral direction thereof. Since the attachment plates 205 are fixed to the bottom part of the pull-down belt mechanism 14, the air nozzles 201 are positioned between the brushes 191 and the bottom open end of the tube 13*b*.

The air blown from the distal ends of the air nozzles 201 blows in the direction of reducing the long axis of the ellipse formed by the cross-sectional shape of the tubular film Fm, and flattening of the tubular film Fm is therefore suppressed. As a result, the packaged articles are also kept from clogging the bottom open end of the tube 13*b*.

INDUSTRIAL APPLICABILITY

Through the present invention, the amount of packaging material used can be reduced while fragmentation of packaged articles and trapping of fragments of packaged articles in the sealed portion are suppressed. The present invention is therefore useful in packaging machines in general.

What is claimed is:

1. A packaging machine that drops articles into a packaging material formed in a tubular shape and seals the packaging material making a bag with the articles packaged therein, the packaging machine comprising:

a pair of sealing jaws configured to move between a jaw open position and a jaw closed position such that in the jaw open position the pair of sealing jaws are spaced apart from the packaging material, and in the jaw closed position the pair of sealing jaws hold the packaging material therebetween in a direction intersecting a conveyance direction of the packaging material and configured to seal the packaging material in the jaw closed position, the conveying direction being vertical;

a pair of rotating brushes configured to undergo reciprocating movement in a horizontal direction at a vertical location relative to the conveyance direction between a brush open position and a brush closed position so as to alternate between moving toward each other from the brush open position to the brush closed position and away from each other from the brush closed position to the brush open position with the packaging material extending therebetween such that in response to being moved to the brush closed position the pair of rotating brushes contact the packaging material while rotating with the packaging material therebetween to impede advancement of the articles in the conveyance direction, the rotating brushes being disposed upstream from the sealing jaws relative to the conveyance direction;

a shutter mechanism configured to move between a shutter open position and a shutter closed position, such that in the shutter closed position the shutter mechanism holds a portion of the packaging material during the sealing of the packaging material by the pair of sealing jaws, the shutter mechanism being disposed upstream from the pair of sealing jaws and downstream from the pair of rotating brushes relative to the conveyance direction; and a controller configured to control timing operation of the sealing jaws, control timing operation of the shutter mechanism and control timing operation of the pair of rotating brushes in the following sequential order:

operating the pair of rotating brushes to begin moving horizontally from the brush open position toward the brush closed position;

operating the shutter mechanism to begin movement from the shutter open position toward the shutter closed position;

thereafter operating the pair of sealing jaws to begin movement from the jaw open position toward the jaw closed position;

thereafter controlling the shutter mechanism to cease movement once in the shutter closed position while controlling the pair of rotating brushes to begin moving to the brush open position away from the brush closed position and the packaging material in order to begin releasing the packaging material, further operating the sealing jaws to complete movement to the jaw closed position such that the pair of rotating brushes begin moving away from the brush closed position after the pair of sealing jaws begin moving from the jaw open position toward the jaw closed position but before the sealing jaws complete movement to the jaw closed position.

2. The packaging machine according to claim 1, wherein the pair of rotating brushes is configured to move into contact with the packaging material therebetween such that advancement of the packaged articles is temporarily impeded by the rotating brushes, and such that the packaging material continues moving in the conveyance direction.

3. The packaging machine according to claim 2, wherein each of the rotating brushes defines a central axis and is operable for rotation about a rotational axis, the rotational axis being spaced apart by a predetermined distance from the central axis of each of the rotating brushes.

4. The packaging machine according to claim 1, wherein each of the pair of rotating brushes is rotatable about a corresponding rotational axis, and each of the rotating brushes defines a central axis and is operable for rotation about the rotational axis, the rotational axis being spaced apart by a predetermined distance from the central axis of each of the rotating brushes.

5. The packaging machine according to claim 1, wherein each of the rotating brushes includes a plurality of bristles that are made of resin.

6. The packaging machine according to claim 5, wherein the bristles of each of the rotating brushes are disposed about an outer circumference of the rotating brushes, the bristles being distributed about the outer circumference with differing densities.

7. The packaging machine according to claim 1, wherein each of the rotating brushes includes a plurality of bristles, the bristles of each of the rotating brushes being disposed about an outer circumference of the rotating brushes, the bristles being distributed about the outer circumference with differing densities.

8. The packaging machine according to claim 1, wherein each of the rotating brushes includes a plurality of bristles, the bristles of each of the rotating brushes are disposed about an outer circumference of the rotating brushes, such that a first portion of the outer circumference includes a first bristle density and a second portion of the outer circumference includes a second bristle density that is greater than the first bristle density.

* * * * *